US010249940B2

(12) United States Patent
Moon et al.

(10) Patent No.: US 10,249,940 B2
(45) Date of Patent: Apr. 2, 2019

(54) SIGNAL DISTRIBUTING/COMBINING APPARATUS IN ANTENNA APPARATUS OF MOBILE COMMUNICATION BASE STATION

(71) Applicant: KMW INC., Hwaseong-si (KR)

(72) Inventors: Young-Chan Moon, Hwaseong-si (KR); Sung-Hwan So, Hwaseong-si (KR); Hun-Jung Jung, Hwaseong-si (KR); Kwang-Seok Choi, Hwaseong-si (KR); Jae-Jeng Choi, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 15/705,294

(22) Filed: Sep. 15, 2017

(65) Prior Publication Data

US 2018/0006363 A1 Jan. 4, 2018

Related U.S. Application Data

(63) Continuation of application No. PCT/KR2015/013737, filed on Dec. 15, 2015.

(30) Foreign Application Priority Data

Mar. 16, 2015 (KR) ..... 10-2015-0035802

(51) Int. Cl.
*H01Q 1/24* (2006.01)
*H01Q 1/46* (2006.01)
(Continued)

(52) U.S. Cl.
CPC ..... *H01Q 1/246* (2013.01); *H01Q 1/38* (2013.01); *H01Q 1/46* (2013.01); *H01Q 15/14* (2013.01)

(58) Field of Classification Search
CPC ..... H01Q 1/246; H01Q 1/38; H01Q 15/14; H01Q 1/46
(Continued)

(56) References Cited

U.S. PATENT DOCUMENTS

2011/0101792 A1* 5/2011 Koumoto ..... B60L 5/005 307/104
2012/0188140 A1* 7/2012 Bin Jamlus ..... H01Q 9/26 343/795
2017/0331184 A1* 11/2017 Langenberg ..... H01Q 1/22

FOREIGN PATENT DOCUMENTS

EP 0973231 A2 1/2000
KR 10-2009-0035318 A 4/2009
(Continued)

OTHER PUBLICATIONS

International Search Report for PCT/KR2015/013737, dated Mar. 31, 2016, and its English translation.

*Primary Examiner* — Peguy Jean Pierre

(57) ABSTRACT

A signal distributing/combining apparatus in an antenna device of a mobile communication base station includes a circuit board configured to have an upper surface formed with a signal distributing/combining conductor pattern for a high frequency signal distributing/combining operation, and a support plate configured to have an upper mounting surface of a size corresponding to the circuit board, to mate with the circuit board so that an underside of the circuit board is in close contact with the upper mounting surface for supporting the circuit board, and to fixedly mate with the antenna device at a reflection plate on a bottom side of the support plate. The support plate is provided with a plurality of cable holders for supporting and fixating coaxial cables for signal transmission which are connected from outside of the apparatus.

12 Claims, 20 Drawing Sheets

(51) Int. Cl.
*H01Q 1/38* (2006.01)
*H01Q 15/14* (2006.01)

(58) Field of Classification Search
USPC ..... 343/384, 795
See application file for complete search history.

(56) References Cited

FOREIGN PATENT DOCUMENTS

| | | | |
|---|---|---|---|
| KR | 10-1092628 | B1 | 12/2011 |
| KR | 10-2012-0068560 | A | 6/2012 |
| KR | 10-2012-0114913 | A | 10/2012 |
| KR | 10-2013-0044887 | A | 5/2013 |

* cited by examiner

SIGNAL DISTRIBUTING/COMBINING APPARATUS IN ANTENNA APPARATUS OF MOBILE COMMUNICATION BASE STATION

CROSS-REFERENCE TO RELATED APPLICATIONS

The present application is a continuation of International Patent Application No. PCT/KR2015/013737, filed Dec. 15, 2015, which claims priority to Korean Patent Application No. 10-2015-0035802, filed on Mar. 16, 2015. The disclosures of the above-referenced applications are hereby incorporated by reference herein in their entirety.

TECHNICAL FIELD

In some embodiments, the present disclosure relates to an antenna device applicable to a base station and a relay station in a mobile communication (PCS, cellular, CDMA, GSM, LTE, etc.) network. More particularly, the present disclosure in some embodiments relates to a signal distributing/combining apparatus for distributing or combining radio frequency (RF) signals in an antenna device.

BACKGROUND

Generally, a base station or a relay station (hereinafter collectively referred to as "base station") of a mobile communication system has been divided into a base station main unit configured to process transmit and receive signals and an antenna device including a plurality of radiating elements for transmitting/receiving radio signals. The base station main unit is usually installed at a low position on the ground, and the antenna device is installed at a high position such as a building roof or a tower, and the base station main unit and the antenna device may be connected to each other through a feeding cable or the like.

The antenna device of the base station includes a plurality of radiating elements for transmitting/receiving high frequency radio signals. At this time, the radiating elements are installed on one surface (for example, the front surface) of a metal reflecting plate having a relatively large area. Further, the antenna device is provided with various circuits or devices for processing signals transmitted and received via the plurality of radiating elements, and, for example, the circuits or devices may be fixedly installed on the back face of the reflecting plate. Such devices may include a phase shifter for adjusting the phase of the signals of the multiple radiating elements, and an apparatus for distributing/combining the transmit and receive signals of the internal devices and the radiating elements. At this time, the respective devices may be connected via a signal transmission line, and a substantial portion of which is formed of coaxial cable.

Meanwhile, in the antenna device of such a structure, it is a serious matter, in addition to having the required transmission/reception properties of the signal for the band, to suppress PIMD (Passive Intermodulation Distortion) generated by discontinuous contact surfaces, unstable connection state or other causes in the respective device structure itself and at the connections between devices.

In this case, the antenna device almost invariably requires a signal distributing/combining apparatus and the structure for making connections through soldering a coaxial cable to that signal distributing/combining apparatus, which in turn requires effective measures to suppress PIMD that can be generated due to unstable connection state occurring at the connections between the signal distributing/combining apparatus and the coaxial cable or due to nonuniform soldering state, etc.

DISCLOSURE

Technical Problem

Therefore, in some embodiments, the present disclosure seeks to provide a signal distributing/combining apparatus in a mobile communication base station antenna apparatus, which is capable of suppressing the PIMD generated at the connection with the coaxial cable, stabilizing the quality of soldering at the connection, and stabilizing the grounding quality of the apparatus.

SUMMARY

In accordance with some embodiments of the present disclosure, a signal distributing/combining apparatus in an antenna device of a mobile communication base station includes a circuit board and a support plate. The circuit board is configured to have an upper surface formed with a signal distributing/combining conductor pattern for a high frequency signal distributing/combining operation. The support plate is configured to have an upper mounting surface of a size corresponding to the circuit board, to mate with the circuit board so that an underside of the circuit board is in close contact with the upper mounting surface for supporting the circuit board, and to fixedly mate with the antenna device at a reflection plate on a bottom side of the support plate. Here, the support plate is provided with a plurality of cable holders for supporting and fixating coaxial cables for signal transmission, which are connected from outside of the signal distributing/combining apparatus, the signal distributing/combining conductor pattern is formed with a plurality of signal input/output portions. The plurality of cable holders is formed on the signal distributing/combining conductor pattern at portions corresponding to at least some of the plurality of signal input/output portions, the cable holders having a structure formed elongated longitudinally and corresponding to outer conductors of the coaxial cables in order to mount the coaxial cable by inserting the outer conductors.

The cable holders may be formed at predetermined positions in the support plate such that inner conductors of the coaxial cables are placed in contact with the upper surface of the circuit board.

The underside of the circuit board and the upper mounting surface of the support plate for mounting the circuit board may be bonded together with a solder cream which is melted and cured with a reflow soldering method.

The upper surface of the circuit board may be formed with a coupling conductor pattern for generating a coupling signal in a non-contact coupling scheme with the signal distributing/combining conductor pattern.

The upper surface of the circuit board may be formed with a ground conductor pattern in a peripheral region adjacent to the signal distributing/combining conductor pattern and the coupling conductor pattern, and the ground conductor pattern may have a plurality of via holes for making an electrical connection with grounding layer on the underside of the circuit board.

The support plate may have open areas, and include a plurality of cable holders corresponding respectively to the coaxial cables for mounting the coaxial cables connected to the underside of the circuit board after passing through the open areas.

The support plate may include multiple fastening protrusions which protrude downwardly of the support plate and are respectively formed with screw fastening recesses for screw fastening with a reflection plate of the antenna device.

The support plate may include a mounting surface configured to mount the circuit board and to have one or more partition members formed in a predetermined length and a predetermined height. The circuit board may have one or more slots to be coupled with the partition members in such a manner that the partition members are inserted. And the partition members may be formed so as to protrude from the upper surface of the circuit board on which the conductor pattern is formed to a preset height.

Advantageous Effects

As described above, the signal distributing/combining apparatus in the mobile communication base station antenna device according to at least one embodiment of the present disclosure can suppress the PIMD generated at the connection with the cable, stabilize the quality of the soldering at the connection, and stabilize the grounding quality of the apparatus.

DETAILED DESCRIPTION

Figure 1:
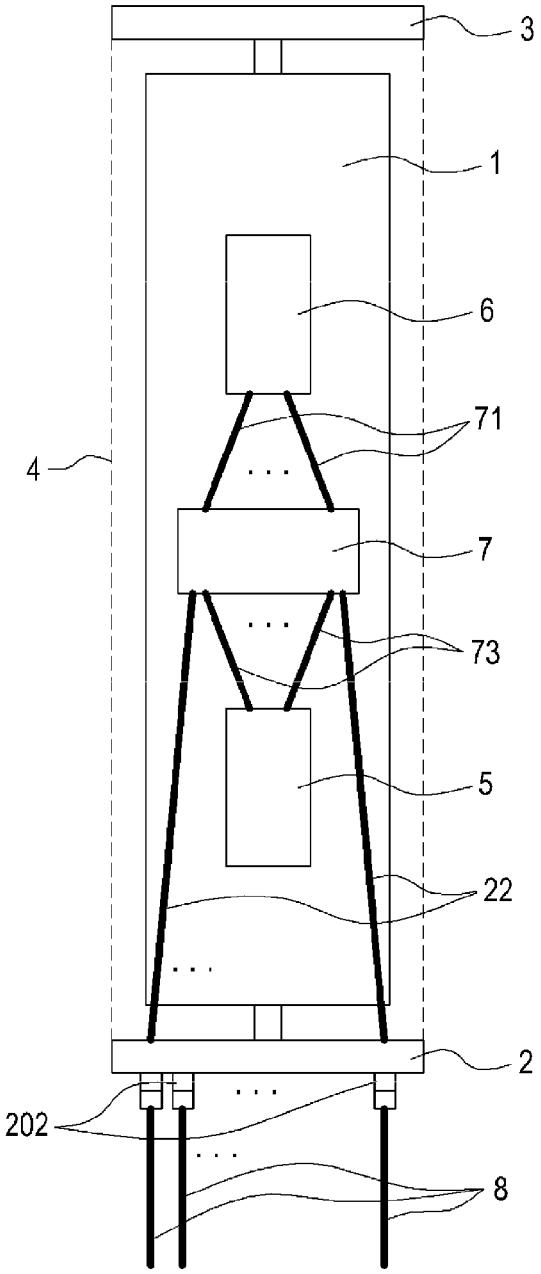
FIG. 1 is a structure of an antenna device of a mobile communication base station to which a signal distributing/combining apparatus according to at least one embodiment of the present disclosure is applied.

Hereinafter, at least one embodiment of the present disclosure will be described in detail with reference to the accompanying drawings. In the following description, specific details such as specific components are disclosed, which are provided only for a better understanding of the present disclosure. It will be apparent to those skilled in the art that various modifications and variations can be made in the present disclosure without departing from the idea or the scope of the disclosure. In the following description, like reference numerals designate like elements as possible, although the elements are shown in different drawings, wherein some reference numerals are refrained from being shown to avoid excessively complicating the drawings.

FIG. 1 is a schematic of a structure of a mobile communication base station antenna device to which a signal distributing/combining apparatus according to at least one embodiment of the present disclosure is applied. Referring to FIG. 1, the base station antenna device is configured as a metal plate having a relatively large area as a whole, and includes a reflection plate 1, an upper phase shifter 6, a lower phase shifter 5, a radome 4, a lower cap 2 and an upper cap 3. The reflection plate 1 has one side (e.g., the front side) mounted with a plurality of radiating elements (not shown) for transmitting/receiving radio signals. The upper and lower phase shifters 6, 5 are installed high and low on the other side (e.g., the rear side) of the reflection plate 1, and adjust the phases of the signals of the multiple radiation elements. The radome 4 is formed in an integrated cylindrical shape to surround interior devices of the antenna including the reflection plate 1 and the upper and lower phase shifters 6, 5. The lower cap 2 and the upper cap 3 fixate upper and lower portions of the reflecting plate 1 respectively, and sealingly join with the upper and lower open portions of the cylindrical radome 4.

Further, a signal distributing/combining apparatus 7 according to at least one embodiment of the present disclosure may be provided, for example, in a central portion on the back surface of the reflection plate 1 of the antenna device. For example, the signal distributing/combining apparatus 7 receives transmitted signals input from the base station's main unit device (not shown) outside the antenna device and distributes the input signals to the antenna's interior devices including the upper and lower phase shifters 6, 5, and it combines the receive signals received via the radiating elements of the antenna device and outputs the combined signals to the base station main unit side.

In addition, the radome 4 of the antenna device may be provided with other additional distributing/combining circuits, or amplifiers, filters, etc. and it may be appropriately installed with various electronic components (not shown) such as a detection circuit for detecting various operational states of the antenna including signal transmission quality and a main control device (e.g., an MCU etc.) for controlling the overall operation. However, for convenience of explanation, illustration of these electronic components is omitted in FIG. 1.

Meanwhile, as shown in FIG. 1, the lower cap 2 is usually installed with a plurality of input/output connectors 202 for inputting/outputting transmit/receive signals to and from the antenna device. The input/output connectors 202 may be directly or indirectly connected to the base station main unit side via a plurality of power supply cables 8. Inside the antenna device, a plurality of coaxial cables 22 may be used as signal transmission transmission lines between the input/output connectors 202 of the lower cap 2 and the signal distributing/combining apparatus 7. In addition, the signal distributing/combining apparatus 7 may be connected with the upper and lower phase shifters 6, 5 via coaxial cables 73, 71, respectively.

FIG. 1 illustrates the upper and lower phase thousands 6, 5 provided in the antenna device, although a different structure of antenna device may be provided with, for example, a single phase shifter. In such differently structured antenna device, the relevant phase shifter may be installed centrally of the back surface of the reflection plate, and the signal distributing/combining apparatus may be installed in the lower part of the back surface of the reflection plate. In that case, the relevant signal distributing/combining apparatus may also be configured to distribute signals to another device (other devices) including the above-mentioned single phase shifter and the radiating elements. In this manner, the installation position of the signal distributing/combining apparatus and its connection structure with other devices may be appropriately set so as to match the antenna device implemented with various structures.

On the other hand, the signal distributing/combining apparatus 7 may be mainly provided with a printed circuit board on which a conductor pattern is formed for high frequency signal distributing/combining. When connecting a coaxial cable to a printed circuit board, it is typical to apply a method of soldering the inner conductor of the coaxial cable to the input/output end of the conductor pattern. Likewise, when connecting the coaxial cable to the signal distributing/combining apparatus 7, the interconnection is also made by a soldering method, but in this case, the signal distributing/combining apparatus 7 according to some embodiments, as will be described later, provides a structure capable of suppressing the occurrence of PIMD, particularly at the connecting portion of the coaxial cable.

Figure 2:
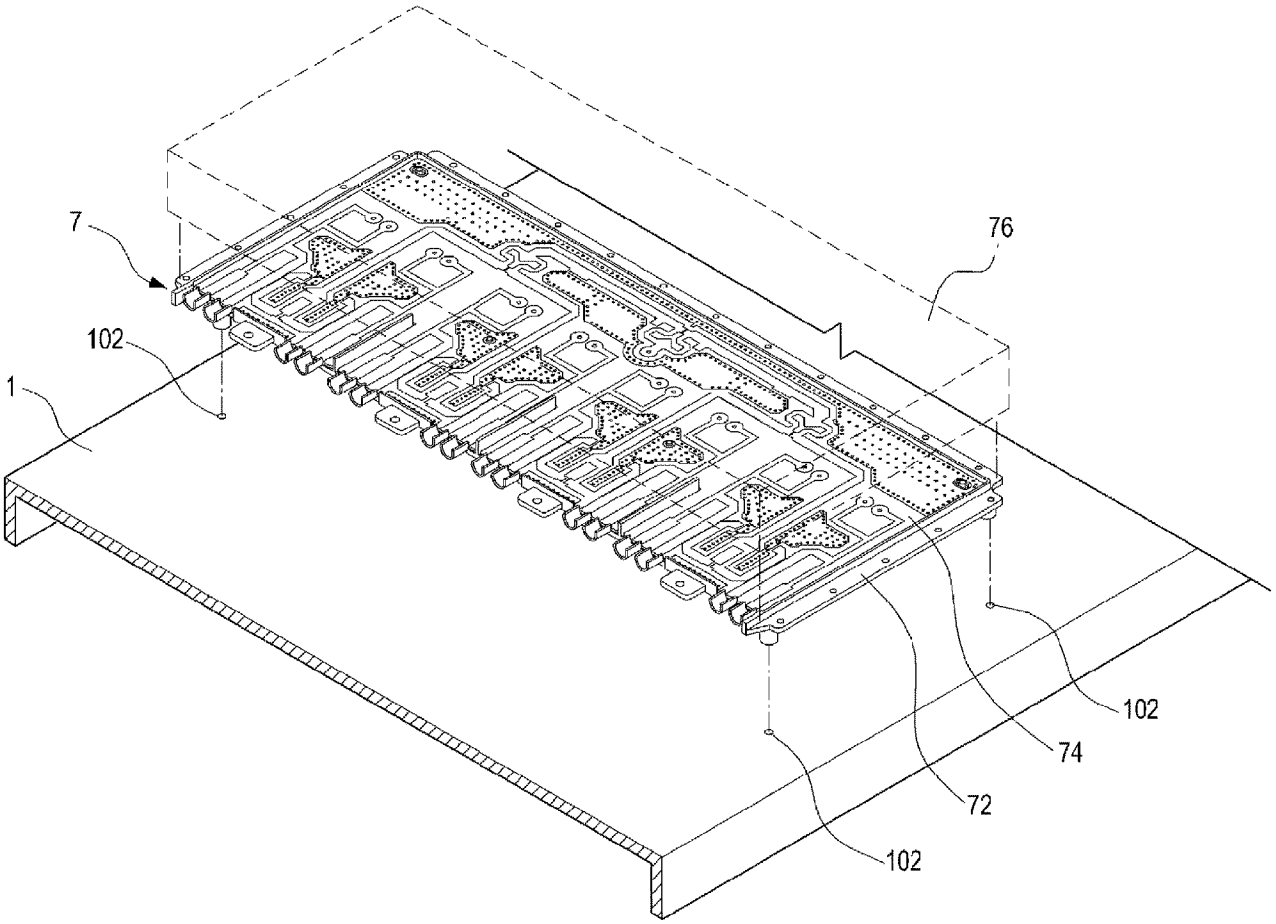
FIG. 2 is a perspective view of a signal distributing/combining apparatus according to at least one embodiment of the present disclosure.
Figure 3:
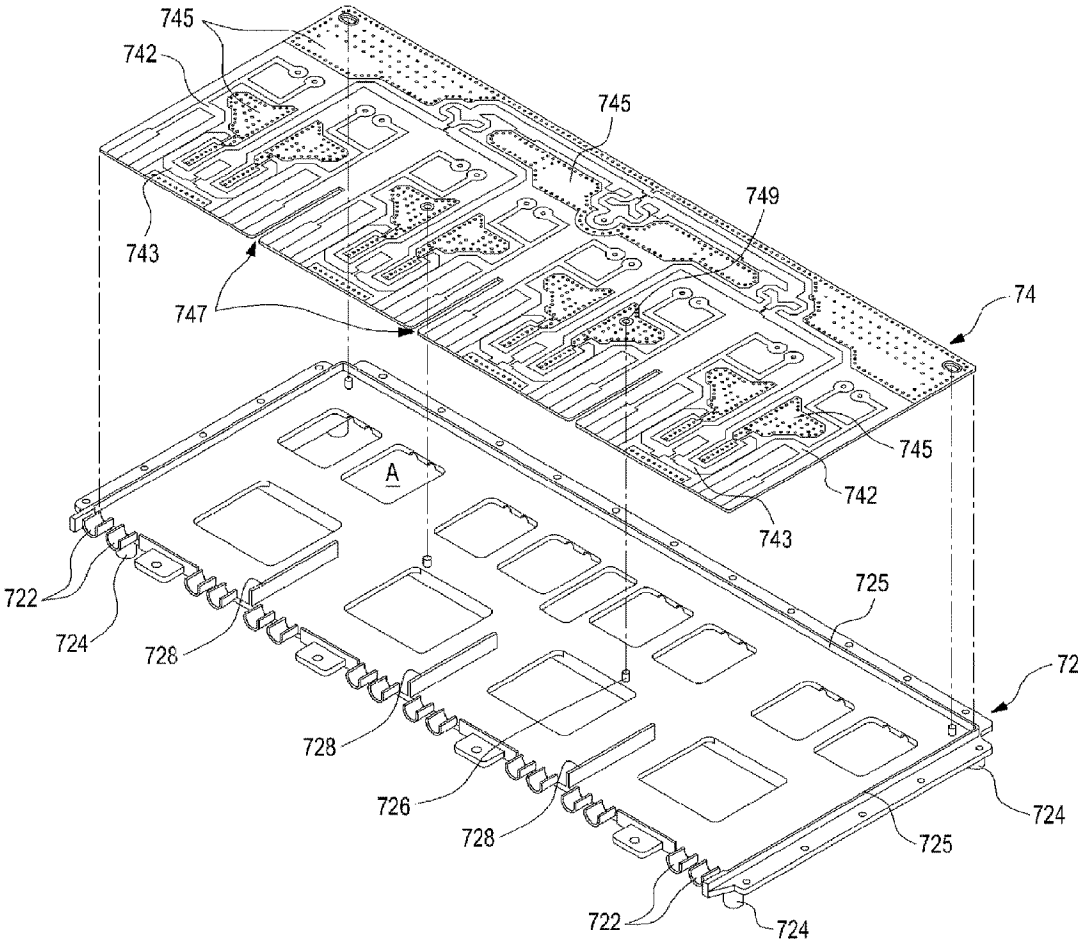
FIG. 3 is an exploded perspective view of a circuit board and a support plate of the signal distributing/combining apparatus of FIG. 2.
Figure 4:
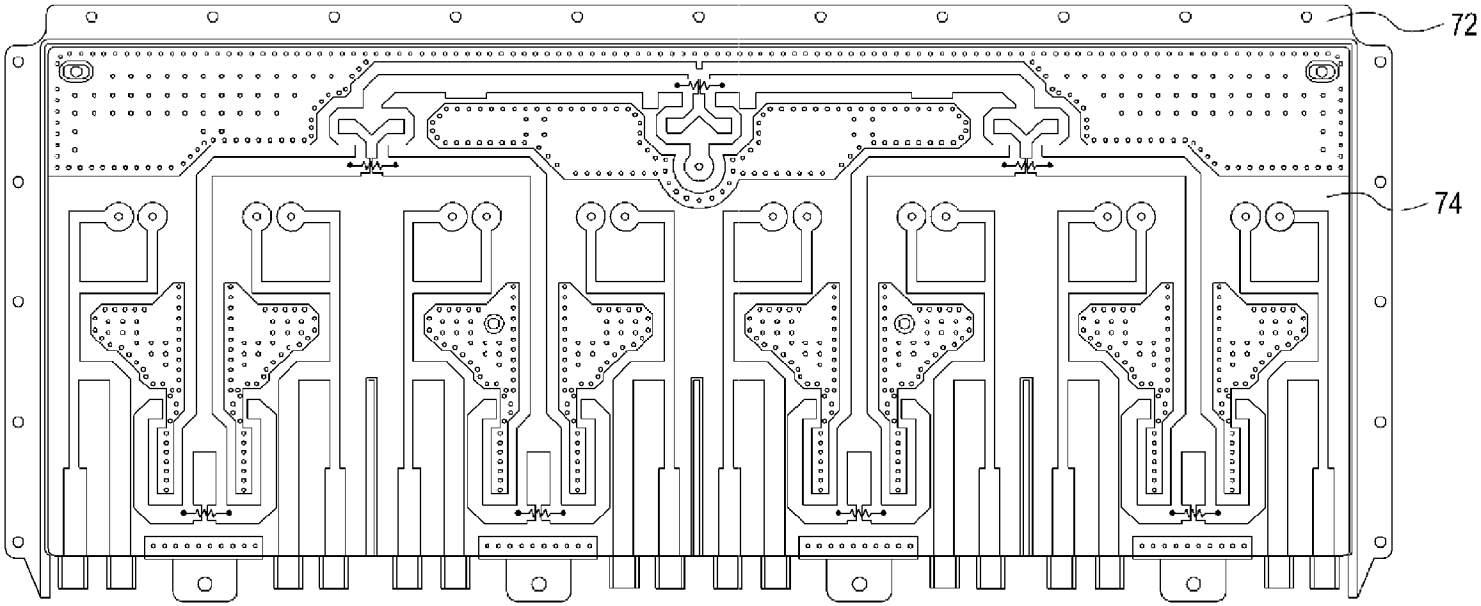
FIG. 4 is a plan view of the signal distributing/combining apparatus of FIG. 2.
Figure 5:
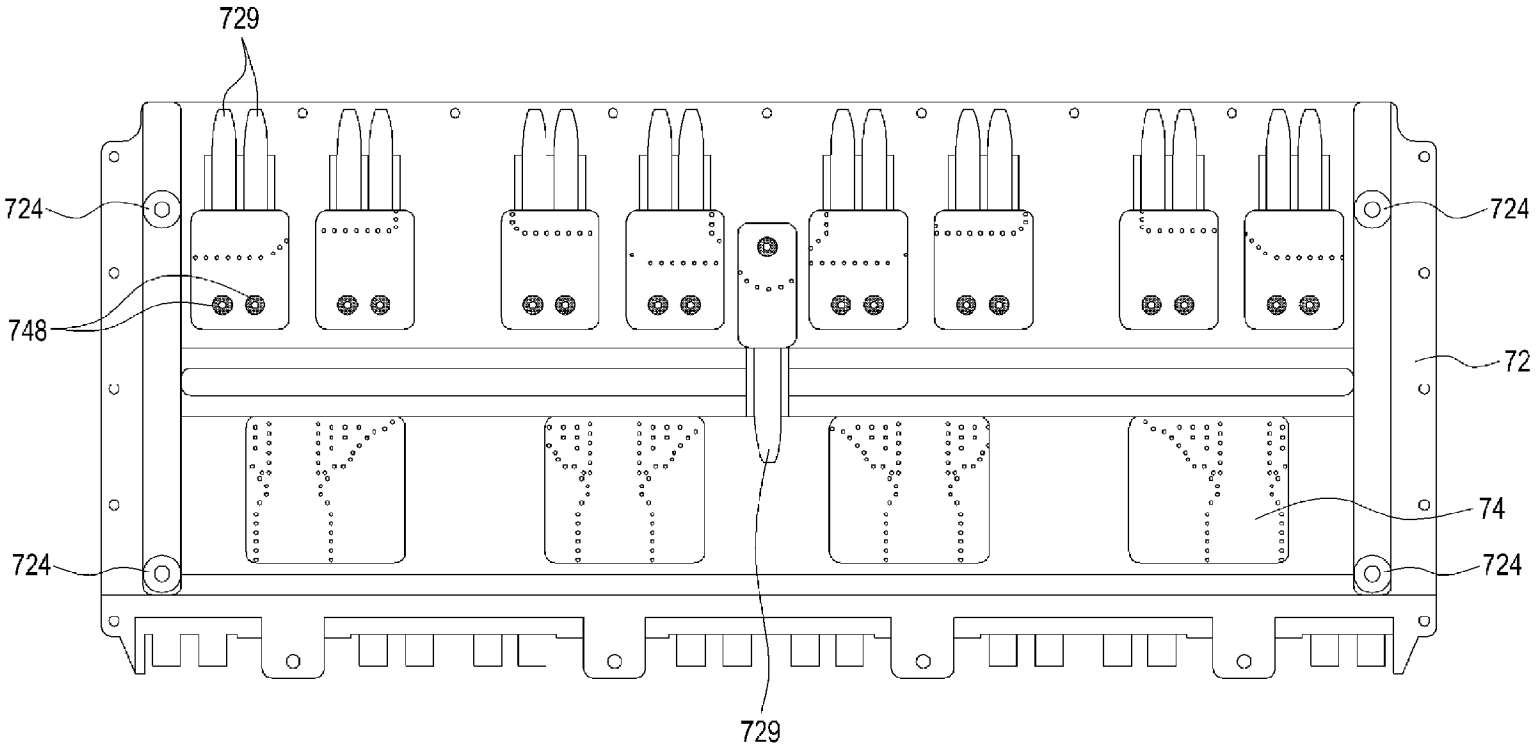
FIG. 5 is a rear view of the signal distributing/combining apparatus of FIG. 2.
Figure 6:
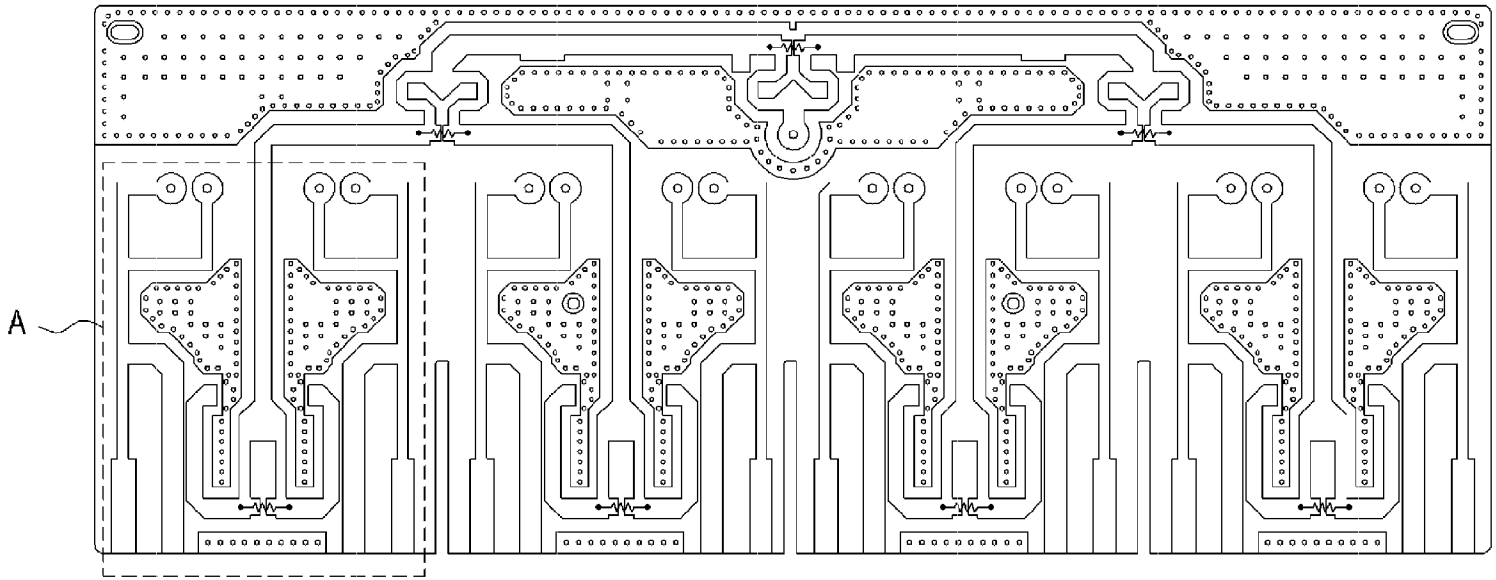
FIG. 6 is a plan view of the circuit board of the signal distributing/combining apparatus of FIG. 2.
Figure 7:
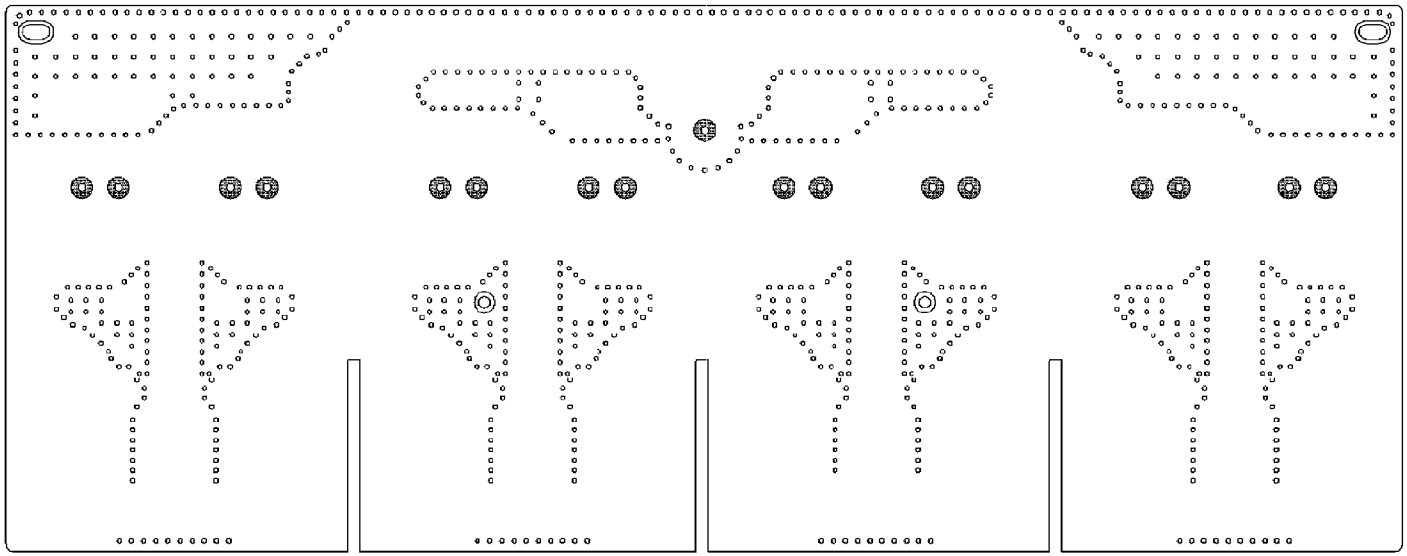
FIG. 7 is a rear view of the circuit board of the signal distributing/combining apparatus of FIG. 2.
Figure 8:
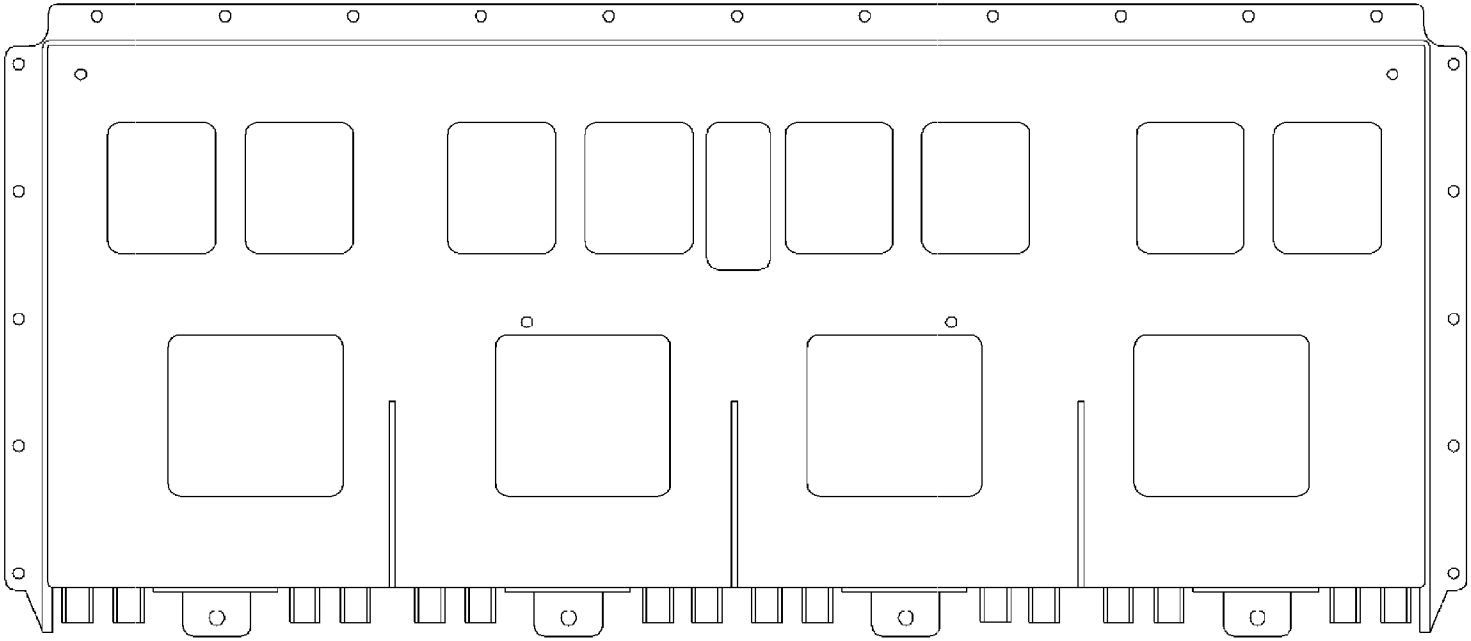
FIG. 8 is a plan view of the support plate of the signal distributing/combining apparatus of FIG. 2.
Figure 9:
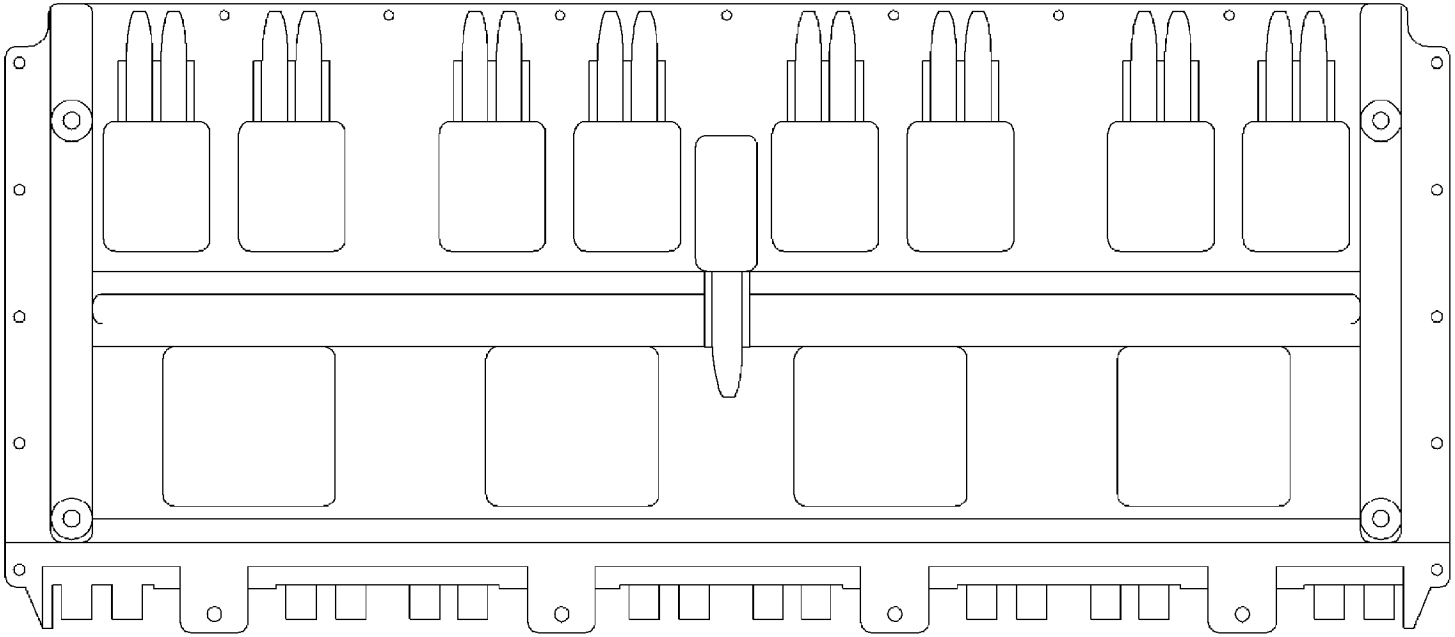
FIG. 9 is a rear view of the support plate of the signal distributing/combining apparatus of FIG. 2.

FIG. 2 is a perspective view of the signal distributing/combining apparatus 7 according to at least one embodiment of the present disclosure, further illustrating the reflector 1. FIG. 3 is an exploded perspective view of a circuit board 74 and a support plate 72 of the signal distributing/combining apparatus 7 of FIG. 2. FIGS. 4 and 5 are respectively a plan view and a rear view of the signal distributing/combining apparatus 7 of FIG. 2. FIGS. 6 and 7 are respectively a plan view and a rear view of the circuit board 74 of the signal distributing/combining apparatus 7 of FIG. 2. FIGS. 8 to 11 are respectively a plan view, a rear view, a first side view and a second side view of the support plate 72 of the signal distributing/combining apparatus 7 of FIG. 2. In particular, FIG. 10, further illustrates the reflector 1.

Referring to FIGS. 2 to 11, the signal distributing/combining apparatus 7 according to at least one embodiment of the present disclosure includes the circuit board 74 and the support plate 72. The circuit board 74 is configured to be formed on its upper surface with at least a signal distributing/combining conductor pattern 742 for carrying out high frequency signal distributing/combining operation. The support plate 72, made of a nonelastic, solid, metallic material, such as aluminum (alloy), is configured to have an upper mounting surface of a size corresponding to the circuit board 74, to mate with the circuit board 74 so that the underside of the circuit board 74 is in close contact with the upper mounting surface for supporting the circuit board 74, and to fixedly mate with the reflection plate 1 of the antenna device on the bottom side of the support plate 72.

As indicated by a dotted box in FIG. 2, in some cases, the signal distributing/combining apparatus may also be configured so that the upper side of the circuit board 74 is covered with a cap-shaped cover 76 made of a metal material (e.g., an aluminum alloy). The cover 76 may be configured to be coupled by screw fastening with the support plate 72. This can be understood to be a structure in which the support plate 72 and the cover 76 serve as an enclosure for enclosing the circuit board 74. Such provision of the cover 74 may further stabilize the signal processing function of the circuit board 74 while increasing the product size of the signal distributing/combining apparatus 7, and therefore it is appropriate to selectively determine whether or not to install the cover 74 depending on the design of the antenna device.

In addition to the signal distributing/combining conductor pattern 742, the circuit board 74 of the signal distributing/combining apparatus 7 may be provided with a coupling conductor pattern 743 for generating a coupling signal in a non-contact coupling scheme with the signal distributing/combining conductor pattern 742. The coupling signal generated by the coupling conductor pattern 743 may be transmitted to the relevant device in order to confirm the quality of the signal transmitted from the corresponding signal distributing/combining conductor pattern 742.

In order to improve the grounding characteristics of the signal distributing/combining conductor pattern 742 and the coupling conductor pattern 743, the circuit board 74 may be further provided, on its upper surface, with a ground conductor pattern 745 in a peripheral region adjacent to the signal distributing/combining conductor pattern 742 and the coupling conductor pattern 743. In the ground conductor pattern 745, particularly at its edge portion, a large number of via holes (reference numeral 7452 in FIG. 14) having fine diameters are formed at small intervals. A grounding layer may be formed on the lower surface of the circuit board 74 in the same way as the structure of the ordinary printed circuit board, and the above-mentioned numerous via holes electrically connect the ground conductor pattern 745 on the upper surface of the circuit board 74 with the grounding layer on the underside of the circuit board 74 to provide the grounding characteristics.

The support plate 72 of the signal distributing/combining apparatus 7 is coupled to the circuit board 74 in a manner that it is in close contact with the lower surface of the circuit board 74, and some embodiments of the present disclosure feature a soldering method for bonding the underside of the circuit board 74 and the upper mounting surface of the support plate 72 for mounting the circuit board 74. For example, the circuit board 74 may be printed with a solder cream where it is joined to the support plate 72, and the circuit board 74 printed with the solder cream may be mounted on the mounting surface of the support plate 72, and thereafter the solder cream may be melted and cured with a reflow soldering method within a high heat furnace. At this time, depending on the material of the support plate 72, in order to enable the soldering operation on the support plate 72 or to improve the quality of soldering, corresponding portions to the solder cream may undergo a plating treatment in advance with a material such as tin. In this way, joining by the circuit board 74 and the support plate 72 by using the reflow soldering method can remarkably stabilize the ground contact quality of the circuit board 74 and the support plate 72.

Further, the support plate 72 may have some areas removed to form a plurality of open areas (indicated by A in FIG. 3) as appropriate. The open areas formed in the supporting plate 72 forms air passages when the circuit board 74 is brought into close contact with the support plate 72 and is soldered, thereby increasing the efficiency of the soldering operation. Similarly, the large number of via holes formed in the ground conductor pattern 745 of the circuit board 74 can also serve as air passages during soldering work of the circuit board 74 and the support plate 72. For this reason, the grounding conductor pattern 745 of the circuit board 74 may be further formed with a plurality of via holes not only for use in improving the grounding characteristics but also for the purpose of increasing the soldering work efficiency. On the other hand, the open areas formed in the support plate 72 may be utilized also when a coaxial cable is desired to be connected to the lower side of the circuit board 74 as described later.

The support plate 72 is also provided with a plurality of cable holders 722 for supporting and fixating coaxial cables for signal transmission. The multiple cable holders 722 each corresponds to the shape and diameter (including some clearance) of the outer conductor of the coaxial cable, in order to mount the coaxial cable in a manner that the outer conductor of the coaxial cable is embedded or placed, by having, for example, a U-shaped structure formed elongated longitudinally.

In the circuit board 74 mounted on the support plate 72, a plurality of signal input/output sections of the signal distributing/combining conductor pattern 742, that is, its areas to be connected with the coaxial cable may be at least partially configured to be formed at one edge of the circuit board 74. To this end, the multiple cable holders 722 are formed in portions corresponding to the plurality of signal input/output portions of the signal distributing/combining conductor pattern 742. Further, the portions where the cable holders 722 are formed are suitably designed in consideration of the thickness of the circuit board 74 or the like so that inner conductors of the coaxial cables fixed by the cable holders 722 are not spaced apart from the upper surface of the circuit board 74 but exactly aligned with the signal input/output portions of the signal distributing/combining conductor pattern 742.

The cable holders 722 may be formed to protrude laterally from one side of the support plate 72, and the support plate 72 including such multiple cable holders 722 may be integrally formed, for example, through a die-casting process.

Once the coaxial cables are attached to the cable holders 722 having such a configuration, soldering work is carried out at the contact portions between the cable holder 722 and the outer conductors of the coaxial cables and at the contact portions between the inner conductors of the coaxial cable and the conductor pattern of the circuit board 74 so that the support plate 72 and the coaxial cable are fixedly connected electrically and mechanically. This method of connecting the coaxial cable for signal transmission to the support plate 72 by utilizing the cable holders 722 enables accurate and uniform processing together with ease of work, and further enables the product after the processing to firmly maintain the connection state between the support plate 72 and the coaxial cables in the actual use environment. This can substantially suppress PIMD that can be generated in the connection part between the relevant signal distributing/combining apparatus and the coaxial cable.

Meanwhile, some of the signal input/output portions of the signal distributing/combining conductor pattern 742 and/or the coupling conductor pattern 743 on the circuit board 74 mounted on the support plate 72 may be formed to connect with the coaxial cable(s) via the underside of the circuit board 74. In that case, the corresponding coaxial cable is connected to the circuit board 74 on the underside of the support plate 72 through the open areas formed in the support plate 72. In other words, the pattern design may dictate some of the signal input/output portions of the conductor pattern to be formed on the circuit board 74 inwardly rather than peripherally of the circuit board 74. In that case, the relevant portions are formed with holes (reference numeral 748 in FIG. 5) for cable connection, and the inner conductor of the coaxial cable is inserted from the lower side of the circuit board 74 through the cable connecting hole into place so as to protrude above the circuit board 74.

The support plate 72 may be further provided on its underside with a plurality of cable holders 729 for fixedly and/or supportively mount the coaxial cables connected to the underside of the circuit board 74. The multiple cable holders 729 each corresponds to the shape and diameter of the coaxial cable, in order to mount the coaxial cable in a manner that the outer conductor of the coaxial cable is embedded or placed, by having at least, for example, a U-shaped groove formed on the lower surface of the support plate 72.

Figure 10:
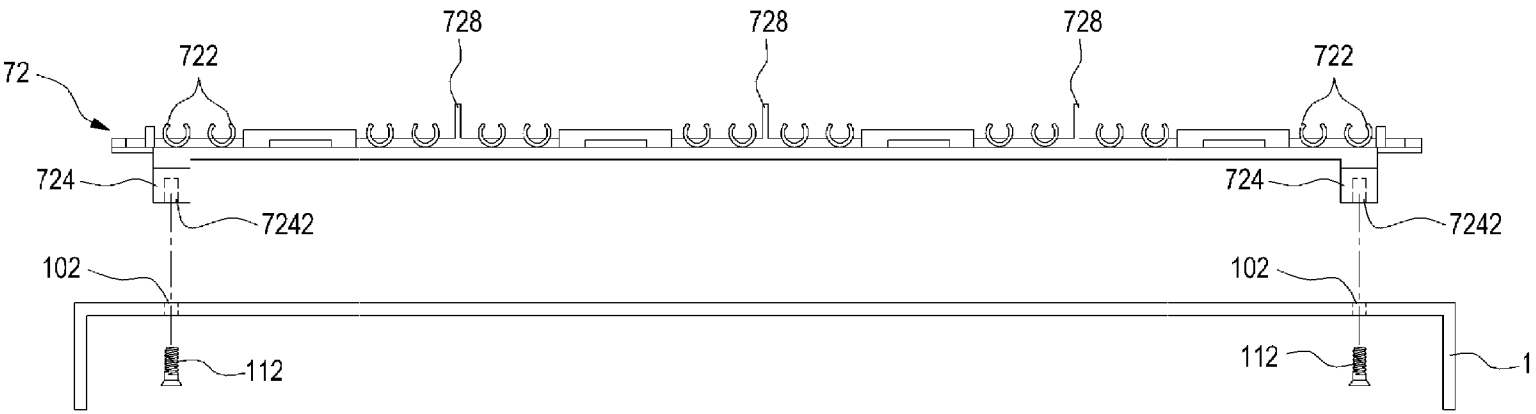
FIG. 10 is a first side view of the support plate of the signal distributing/combining apparatus of FIG. 2.
Figure 11:
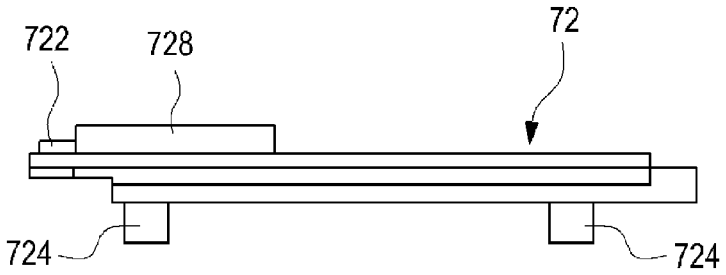
FIG. 11 is a second side view of the support plate of the signal distributing/combining apparatus of FIG. 2.

Further, as shown in FIGS. 1 and 10 in more detail, the support plate 72 has its lower part fixedly coupled with the reflection plate 1 of the antenna device. For this purpose, the lower side of the support plate 72 is formed with multiple fastening protrusions 724 respectively provided with screw fastening recesses 7242. The multiple fastening protrusions 724 may be provided respectively at portions corresponding to the underside corners of the support plate 72 having, for example, a rectangular shape and they may protrude to an appropriate height at which the support plate 72 contacts the reflection plate 1 by the multiple fastening protrusions 724. The reflection plate 1 has a plurality of screw insertion holes 102 formed respectively at positions corresponding to the portions contacted by the multiple fastening protrusions 724. Fastening screws (reference numeral 112 in FIG. 10) are threaded through the plurality of screw insertion holes 102 into the screw fastening recesses 7242 of the multiple fastening protrusions 724, whereby the support plate 72 is fixed to the reflection plate 1. This way of coupling the support plate 72 with the reflection plate 1 may minimize the contact area between the two elements, which in turn mitigates unstable factor of the ground contact.

The support plate 72 may be provided with additional structures for other functions such as facilitating the coupling operation with the circuit board 74 and securing the coupled state. For example, a guardrail member 725 may be formed on the support plate 72 so as to surround at least a part of a mounting surface on which the circuit board 74 is mounted. In addition, the support plate 72 may be formed, on the mounting surface for the circuit board 74, with one or more coupling protrusion members 726, and in correspondence therewith, the circuit board 74 may have one or more coupling holes 749 to be coupled with the coupling protrusion members 726 in such a manner that the coupling projection members 726 are inserted. Further, in the support plate 72, one or more partition members 728 may be formed in an appropriate length, and in correspondence therewith, the circuit board 74 may have one or more slots 747 to be coupled with the partition members 728 in such a manner that the partition members 728 are inserted.

The partition member 728 formed on the support plate 72 is configured to function not only to facilitate the coupling operation and maintain a stable coupling state between the support plate 72 and the circuit board 74 but also to prevent signal leakage or interference of signals between the conductor patterns formed on the circuit board 74. For example, the partition member 728 is formed so as to protrude from the upper surface of the circuit board 74 on which the conductor pattern is formed to a preset height. This provides electrically grounded vertical barrier walls of the partition member 728 to its opposite side conductor patterns on the circuit board 74. Multiples of such partition member 728 minimize signal leakage or signal interference between the conductor patterns with their partition member 728 interposed.

For example, the antenna device may have a multi-band service structure wherein the signal/distribution coupling conductor pattern 742 is formed with distinguishable conductor patterns for signal distributing/combining for each band. In such a structure, the partition member 728 may formed to be positioned between the conductor patterns for band-specific signal distributing/combining so as to prevent band-specific signal leakage and signal interference.

Figure 12A:
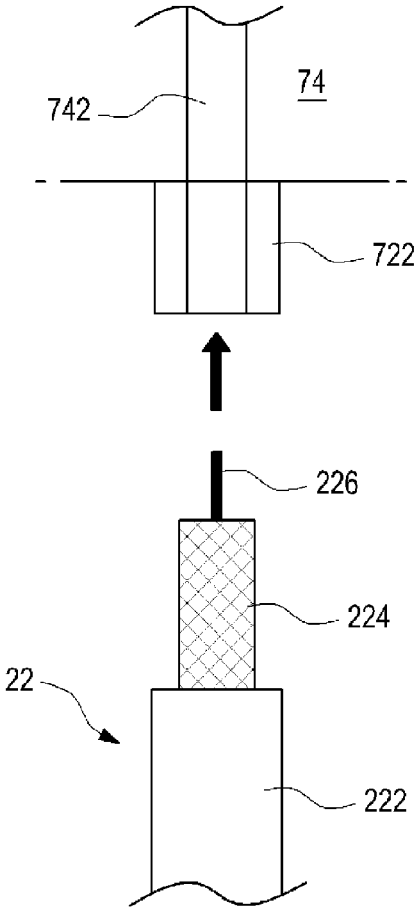
FIG. 12A and FIG. 12B are exemplary views of a connection structure between the signal distributing/combining apparatus of FIG. 2 and a coaxial cable.
Figure 12B:
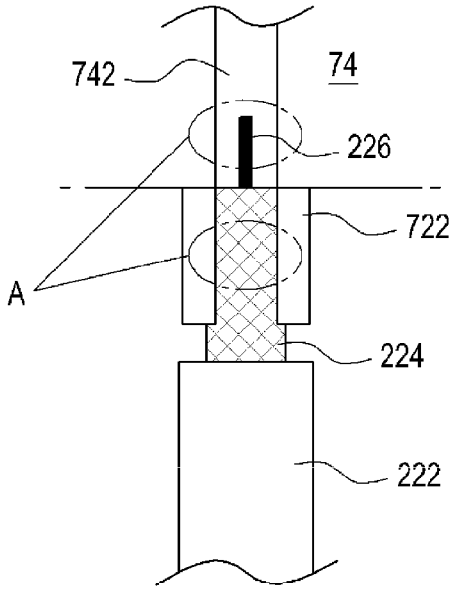

FIGS. 12A and 12B are illustrations showing a connection structure between the signal distributing/combining apparatus 7 and the coaxial cable 22 in FIG. 2, whereby the coaxial cable 22 is connected to the cable holder 722 on the upper portion of the signal distributing/combining apparatus 7. At this time, the signal distributing/combining apparatus 7 and the coaxial cable 22 are shown before and after their interconnection in FIGS. 12A and 12B, respectively. As illustrated, the coaxial cable 22 is coupled to the cable holder 722 with its insulating and protective sheath 222 and the outer conductor 224 removed so that certain portions of the grounding outer conductor 224 and the signal transmission inner conductor 226 are exposed.

At this time, the external conductor 224 of the coaxial cable 22 is inserted firmly in the cable holder 722 so that the coaxial cable 22 is fixed by the cable holder 722 with the inner conductor 226 contacting the signal input/output section of the signal distributing/combining conductor pattern 742. Thereafter, as shown in the dot-dash line circles A of FIG. 12B, soldering work is performed on the contact portion between the cable holder 722 and the external conductor 224 of the coaxial cable 22 and on the connection portion of the internal conductor 226 of the coaxial cable 22 and the signal distributing/combining conductor pattern 742.

Figure 13A:
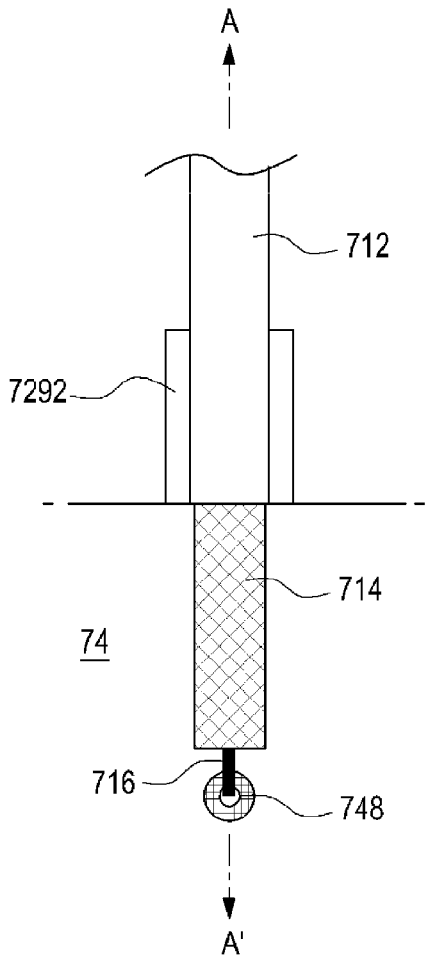
FIGS. 13A, 13B and 13C are exemplary views of another connection structure between the signal distributing/combining apparatus of FIG. 2 and a coaxial cable.
Figure 13B:
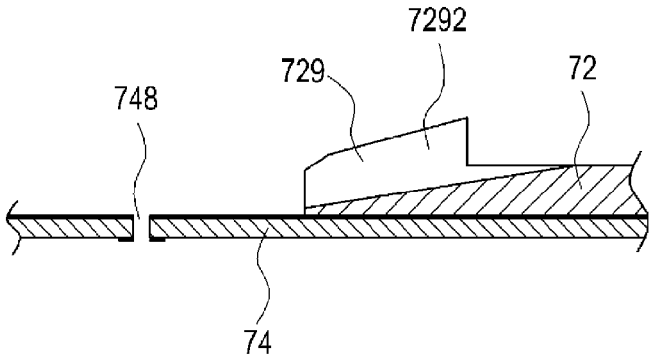
Figure 13C:
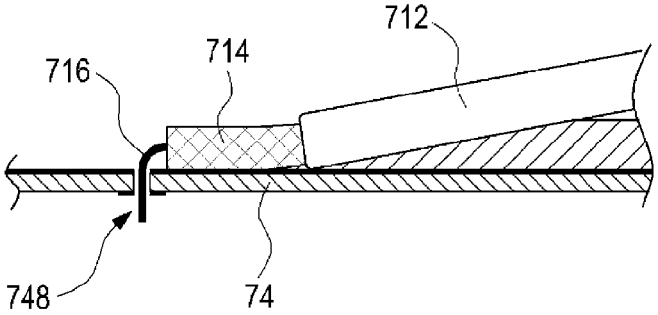

FIGS. 13A, 13B and 13C are exemplary views of another connection structure between the signal distributing/combining apparatus of FIG. 2 and a coaxial cable, wherein a coaxial cable 71 is coupled to the cable holder 729 on the underside of the signal distributing/combining apparatus 7. At this time, FIG. 13A is an elevation view showing that the coaxial cable 71 is connected to the cable holder 729, and FIGS. 13B and 13C are cross-sectional views taken along line A-A' in FIG. 13A. FIG. 13B shows the apparatus with the coaxial cable 71 removed to facilitate understanding. As FIGS. 13A to 13C illustrate, the coaxial cable 71 is coupled to the cable holder 729 with its sheath 712 and outer conductor 714 partially removed so that certain portions of the outer conductor 714 and an inner conductor 716 are exposed.

At this time, a part of the covering 712 of the coaxial cable 71 is inserted or placed in the cable holder 729 so that the coaxial cable 71 is fixed by the cable holder 729 with the outer conductor 714 contacting the ground layer on the underside of the circuit board 74. The inner conductor 716 of the coaxial cable 71 is installed by inserting into a cable connection hole 748 formed in the circuit board 74. On the other hand, to better secure the coaxial cable 71 held in the cable holder 729, the cable holder 729 may be formed to have a guard member 7292 structured for clamping that coaxial cable 71 by its side.

Figure 14:
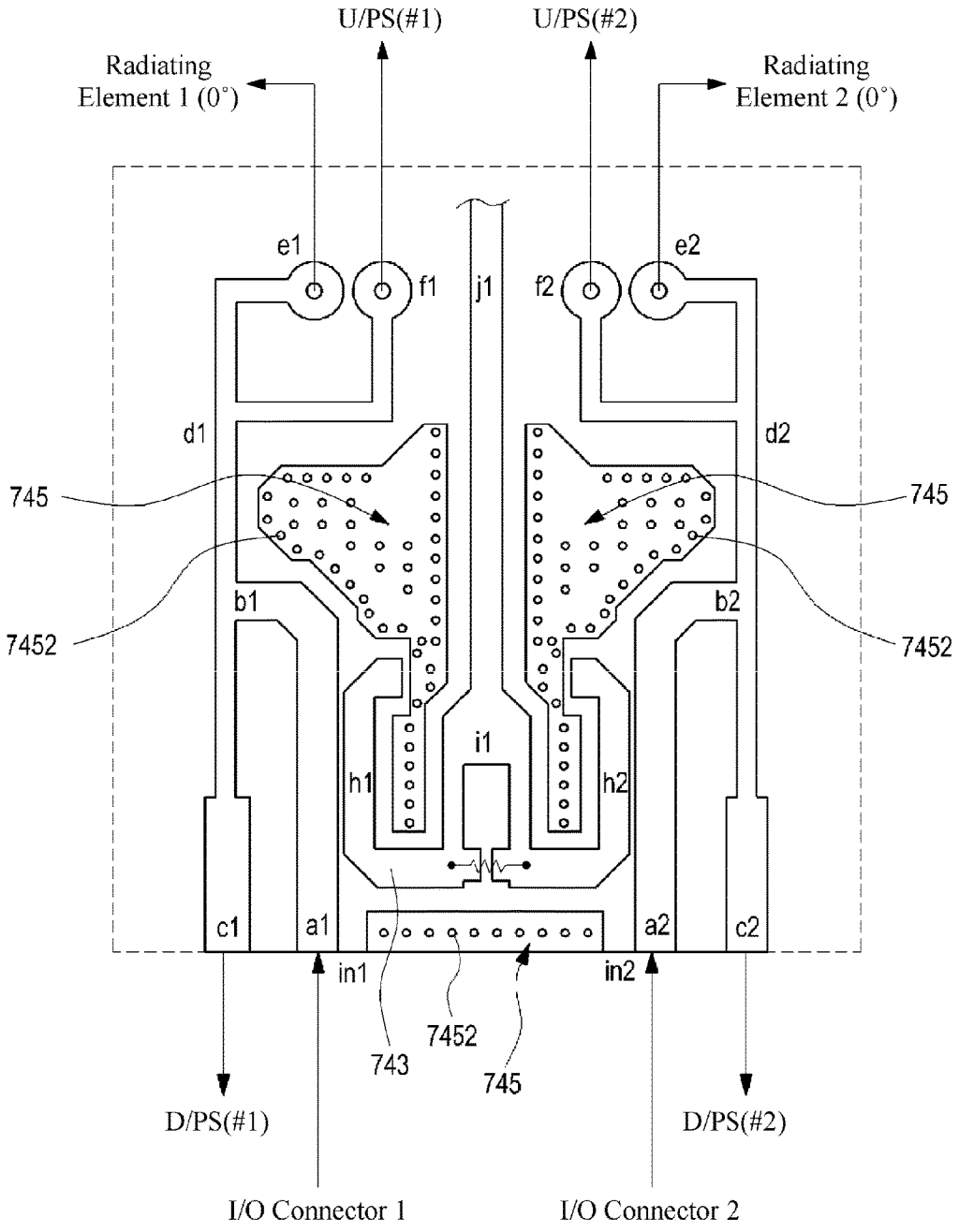
FIG. 14 is an enlarged view of a partial circuit pattern of the circuit board of the signal distributing/combining apparatus of FIG. 2.

FIG. 14 is an enlarged view of a partial circuit pattern of the circuit board 74 of the signal distributing/combining apparatus 7 in FIG. 2, and shows, for example, the corresponding circuit pattern indicated by part A in FIG. 6. The corresponding circuit pattern may be a circuit configuration for combining/distributing signals of a single band in a multiband service structure. With reference to FIG. 14, the configurations of the signal distributing/combining conductor pattern and the coupling conductor pattern of the circuit board 74 will be described in more detail.

First, a signal distributing/combining conductor pattern will be described. For example, a signal (for example, a transmit signal) provided from a first input/output connector (I/O connector 1) through the coaxial cable is input to a pattern a1 which is a first input terminal 'in1', and the input signal at pattern a1 is subsequently distributed from patterns b1 and d1 to a downward or lower phase shifter D/PS #1, a 0 degree phase-shift radiating element 1 (i.e., with no phase shift) and an upward or upper phase shifter U/PS #1. The signal for distribution to the lower phase shifter D/PS #1 is provided to a pattern c1, the signal for distribution to the radiating element 1 is provided to a pattern e1, and the signal for distribution to the upper phase shifter U/PS #1 is provided to a pattern f1.

In ordinary antenna devices, the radiating elements in a single service band are arranged in a row in the vertical direction, and for vertical steering adjustment, the radiating elements in the normally vertical arrangement are relatively phase shifted based on their positions in the arrangement. In the antenna having such a structure, for example, the radiating elements positioned on the upper side with respect to the centrally positioned radiating element (radiating element with no phase shift) are phase shifted through the aforementioned upper phase shifter by a positive [+] angle to have respective phase differences, and the radiating elements positioned thereunder are phase shifted through the aforementioned lower phase shifter by a negative [−] angle to have the respective mutual phase differences.

In concert with this arrangement, the signal distributing/combining conductor pattern as described above may appropriately distribute the signal input by one input/output connector (I/O connector 1) and transfer the signal via the pattern c1 to the lower phase shifter D/PS #1, via the pattern e1 to the radiating element with no phase shift, and via the pattern f1 to the upper phase shifter U/PS #1. Detailed structures such as the shapes and lengths of the patterns a1 to f1 are appropriately designed in consideration of the phase, mutual impedance and others of the signals to be distributed and transferred.

On the other hand, a signal provided from a second input/output connector (I/O connector 2) through the coaxial cable is input to a pattern a2 which is a second input terminal 'in2', and the input signal at pattern a2 is subsequently distributed from patterns b2 and d2 for further subsequent distribution via patterns c2, f2 and e2 to a lower phase shifter D/PS #2, a 0 degree phase-shift radiating element 2 (i.e., with no phase shift) and an upper phase shifter U/PS #2, respectively.

It can be understood from the signal distributing/combining conductor pattern as illustrated that, in a dual polarized antenna structure for example, the patterns for processing the signal input at the first input/output connector (I/O connector 1) are the signal processing pattern for generating a polarized wave of +45 degree, and the patterns for processing the signal input at the second input/output connector (I/O connector 2) are the signal processing pattern for generating a polarized wave of −45 degree. In addition, the above signal distributing/combining conductor pattern has been described by exemplifying the function of distributing transmit signals, but it can be understood that this pattern can do the reverse as well for performing to combine and provide the receive signals to the I/O connector side. In other words, the signal distributing/combining conductor pattern in FIG. 14 corresponds to the structure of 2T2R (2 Tx 2 Rx) in an antenna device, and the whole signal distributing/combining conductor pattern shown in FIG. 2 et al. has a structure generally corresponding to the 8T8R structure.

On the other hand, in FIG. 14, the coupling conductor pattern includes an h1 pattern and an h2 pattern for coupling the transmission signal by the pattern a1 and the transmission signal of the pattern a2 in the signal distributing/combining conductor pattern, respectively. The signals coupled by the patterns h1 and h2 are then combined by a pattern i1 and transmitted to a pattern j1. The signal delivered to the pattern j1 is then transmitted to the relevant device (or externally) to analyze the transmitted signal to determine the quality of the signals (e.g., transmit signals) transferred from the patterns a1 and a2. At this time, since the signals coupled by the pattern h1 and the pattern h2 are arranged to be combined by the pattern i1, checking the quality of the signals may be performed by distinguishably setting the respective transmission periods of the transmit signals transferred from the pattern a1 and the pattern a2.

Figure 15:
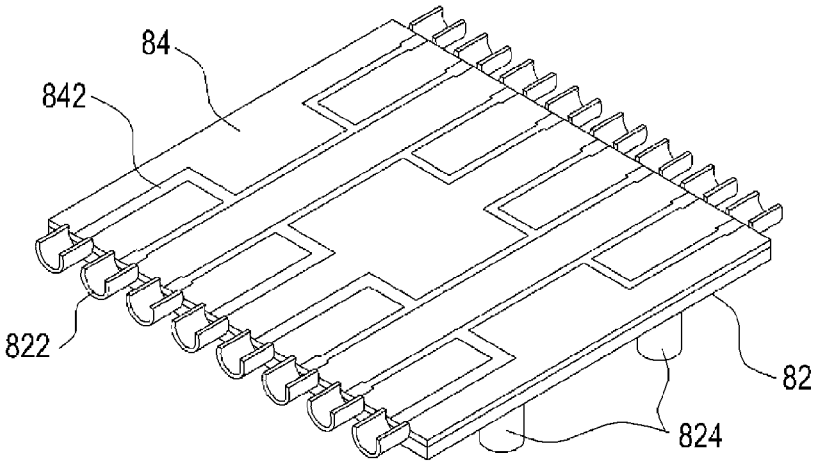
FIG. 15 is a perspective view of a signal distributing/combining apparatus according to another embodiment of the present disclosure.
Figure 16:
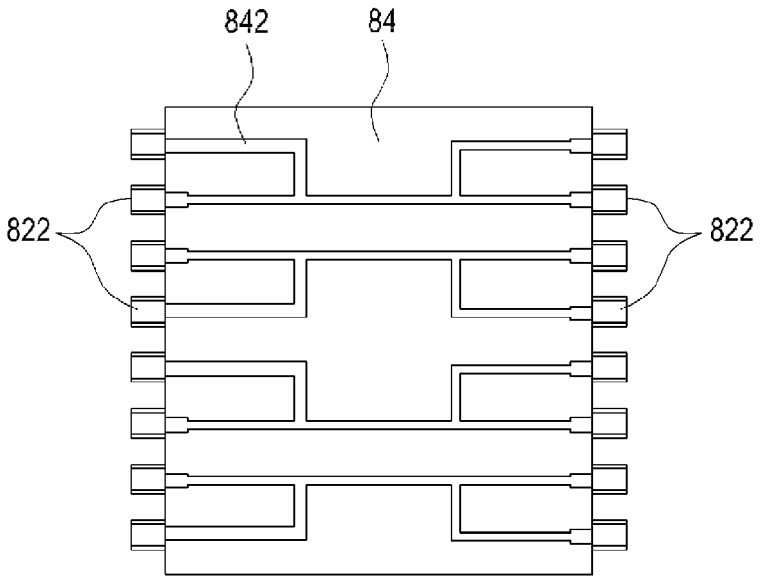
FIG. 16 is a plan view of the signal distributing/combining apparatus of FIG. 15.
Figure 17:
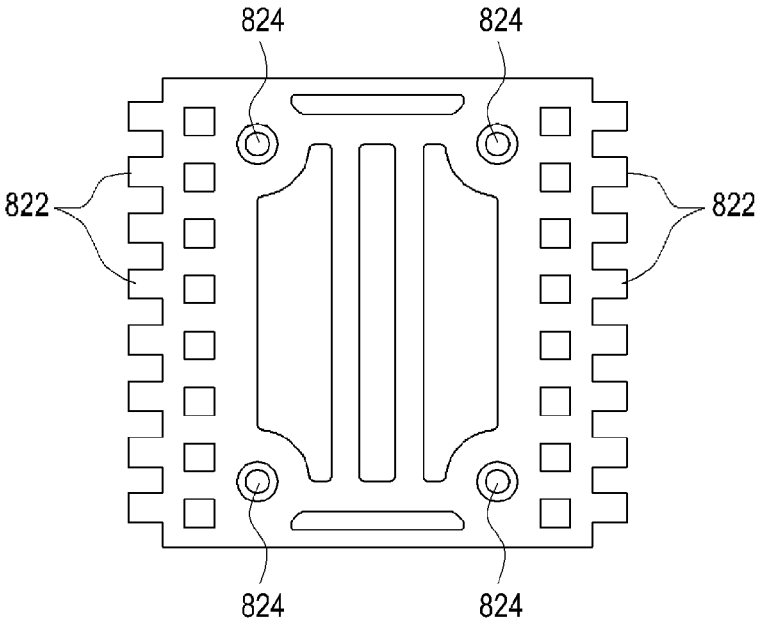
FIG. 17 is a rear view of the signal distributing/combining apparatus of FIG. 15.

FIG. 15 is a perspective view of a signal distributing/combining apparatus according to another embodiment of the present disclosure. FIGS. 16 and 17 are respectively a plan view and a rear view of the signal distributing/combining apparatus of FIG. 15. Referring to FIGS. 15 to 17, the signal distributing/combining apparatus 7 according to another embodiment is similar to the structure according to the embodiment shown in FIG. 2 et al. in that it has a circuit board 84 on which a signal distributing/combining conductor pattern 842 is formed for high frequency signal distributing/combining, and a support plate 82. The support plate 82 is configured to have an upper mounting surface of a size corresponding to the circuit board 84, to mate with the circuit board 84 so that the underside of the circuit board 84 is in close contact with the upper mounting surface for supporting the circuit board 84, and to fixedly mate with the reflection plate of the antenna device on the bottom side of the support plate 82. However, different from the structure of the embodiment shown in FIG. 2 et al., the circuit board 74 according to another embodiment in FIGS. 15 to 17 is not formed with a coupling conductor pattern (743 in FIG. 3) and a ground conductor pattern (745 in FIG. 3).

In addition, the structure of another embodiment as described above may be made similar to that of the embodiment shown in FIG. 2 etc. Specifically, the support plate 82 may be provided with a plurality of cable holders 822 for supporting and fixating coaxial cables for signal transmission, a plurality of fastening portions 824 for coupling with the reflection plate and some areas removed to form open areas.

As described above, the configurations and operations of the signal distributing/combining apparatuses of the present disclosure in an antenna device of the mobile communication base station may be achieved according to some embodiments which are particularized for illustration, but it is to be understood that other variations may be made without departing from the scope of the disclosure.

For example, in the above description, the signal distributing/combining apparatuses according to some embodiments of the present disclosure are disposed centrally of the reflection plate and connected via the coaxial cable to the input/output connector, upper and lower phase shifters, and others, although the signal distributing/combining apparatuses connected via the coaxial cable to various other devices. Further, the signal distributing/combining apparatuses may be properly installed in other parts than the central portion of the reflection plate.

In the above description, the signal distributing/combining conductor pattern of the signal distributing/combining apparatus according to some embodiments of the present disclosure has been explained by way of example, that it corresponds to the 8T8R structure as a whole, but in addition to this, the present disclosure may also be applied to 4T4R or any other structures.

Additionally, in the above-described embodiments, there may be various variations and modifications to the detailed structure of the circuit patterns of the circuit board and/or the detailed structures of the support plate, and therefore the scope of the technical idea of the present embodiments is not limited by the illustrations as above. Accordingly, one of ordinary skill would understand that the scope of the claimed invention is not to be limited by the explicitly described above embodiments but by the claims and equivalents thereof.

The invention claimed is:

1. A signal distributing/combining apparatus in an antenna device of a mobile communication base station, the signal distributing/combining apparatus comprising:

a circuit board configured to have an upper surface formed with a signal distributing/combining conductor pattern for a high frequency signal distributing/combining operation; and a support plate configured to have an upper mounting surface of a size corresponding to the circuit board, to mate with the circuit board so that an underside of the circuit board is in close contact with the upper mounting surface for supporting the circuit board, and to fixedly mate with the antenna device at a reflection plate on a bottom side of the support plate, wherein the support plate is provided with a plurality of cable holders for supporting and fixating coaxial cables for signal transmission, which are connected from outside of the signal distributing/combining apparatus, the signal distributing/combining conductor pattern is formed with a plurality of signal input/output portions, and the plurality of cable holders is formed on the signal distributing/combining conductor pattern at portions corresponding to at least some of the plurality of signal input/output portions, the cable holders having a structure formed elongated longitudinally and corresponding to outer conductors of the coaxial cables in order to mount the coaxial cable by inserting the outer conductors.

2. The signal distributing/combining apparatus of claim 1, wherein the cable holders are formed at predetermined positions in the support plate such that inner conductors of the coaxial cables are placed in contact with the upper surface of the circuit board.

3. The signal distributing/combining apparatus of claim 2, wherein contact portions between the plurality of cable holders and the outer conductors of the coaxial cables are coupled together, and connection portions between the inner conductors of the coaxial cables and at least some of the plurality of signal input/output portions of the signal distributing/combining conductor pattern are coupled together.

4. The signal distributing/combining apparatus of claim 1, wherein the underside of the circuit board and the upper mounting surface of the support plate for mounting the circuit board are bonded together with solder cream.

5. The signal distributing/combining apparatus of claim 1, wherein the upper surface of the circuit board is formed with a coupling conductor pattern for generating a coupling signal in a non-contact coupling scheme with the signal distributing/combining conductor pattern.

6. The signal distributing/combining apparatus of claim 5, wherein the upper surface of the circuit board is formed with a ground conductor pattern in a peripheral region adjacent to the signal distributing/combining conductor pattern and the coupling conductor pattern, and the ground conductor pattern has a plurality of via holes for making an electrical connection with a grounding layer on the underside of the circuit board.

7. The signal distributing/combining apparatus of claim 1, wherein the support plate has some areas removed to form a plurality of open areas.

8. The signal distributing/combining apparatus of claim 7, wherein the support plate comprises a plurality of cable holders corresponding respectively to the coaxial cables for mounting the coaxial cables connected to the underside of the circuit board after passing through the open areas.

9. The signal distributing/combining apparatus of claim 1, wherein the support plate comprises multiple fastening protrusions which protrude downwardly of the support plate and are respectively formed with screw fastening recesses for screw fastening with a reflection plate of the antenna device.

10. The signal distributing/combining apparatus of claim 9, wherein the multiple fastening protrusions are provided respectively at portions corresponding to underside corners of the support plate and protrude to a predetermined height so that the support plate contacts the reflection plate exclusively by the multiple fastening protrusions.

11. The signal distributing/combining apparatus of claim 1, wherein the support plate comprises a mounting surface configured to mount the circuit board and to have one or more partition members formed in a predetermined length and a predetermined height, the circuit board has one or more slots to be coupled with the partition members in such a manner that the partition members are inserted, and the partition members are formed so as to protrude from the upper surface of the circuit board on which the conductor pattern is formed to a preset height.

12. The signal distributing/combining apparatus of claim 1, further comprising a cap-shaped cover made of a metal material configured to be coupled by screw fastening with the support plate, and to cover an upper side of the circuit board.

* * * * *